United States Patent [19]

Lazzari et al.

[11] 4,134,557

[45] Jan. 16, 1979

[54] DEVICE FOR PROPELLING GRINDING BODIES IN A GRINDING MILL

[75] Inventors: Armando Lazzari; Alfredo Cartoceti; Eberhart Steinort, all of Varese, Italy

[73] Assignee: I.O.S. Industria Ossidi Sinterizzati S.r.l., Malgesso (Varese), Italy

[21] Appl. No.: 801,064

[22] Filed: May 27, 1977

[30] Foreign Application Priority Data

Sep. 29, 1976 [IT] Italy ..... 27771 A/76

[51] Int. Cl.[2] ..... B02C 17/18

[52] U.S. Cl. ..... 241/170

[58] Field of Search ..... 241/170, 171, 172, 179, 241/284

[56] References Cited

U.S. PATENT DOCUMENTS

| | | | |
|---|---|---|---|
| 1,894,106 | 1/1933 | Lehrack | 241/172 |
| 2,175,321 | 10/1939 | Saffir | 241/172 |
| 2,350,534 | 6/1944 | Rosinger | 241/172 UX |
| 3,398,902 | 8/1968 | Khomeriki | 241/170 |
| 3,545,687 | 12/1970 | Mosby et al. | 241/172 X |

*Primary Examiner*—Howard N. Goldberg

*Attorney, Agent, or Firm*—Gifford, Chandler, VanOphem, Sheridan & Sprinkle

[57] ABSTRACT

A ball grinding mill in which the grinding bodies are formed at least partially of ferro-magnetic material and are propelled about the grinding chamber by a magnetic field.

3 Claims, 9 Drawing Figures

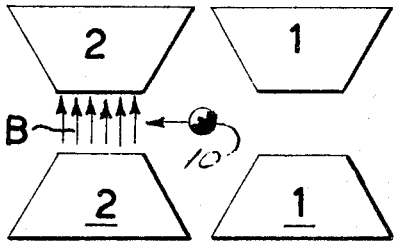
FIG. 5
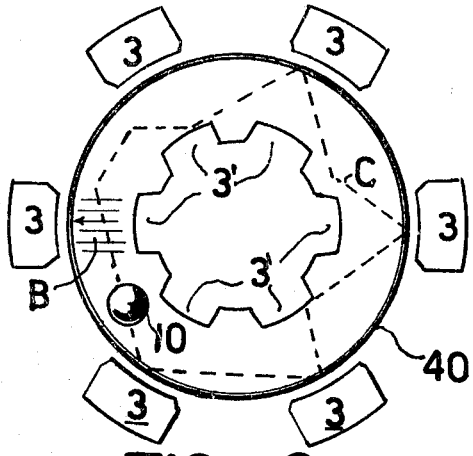
FIG. 6
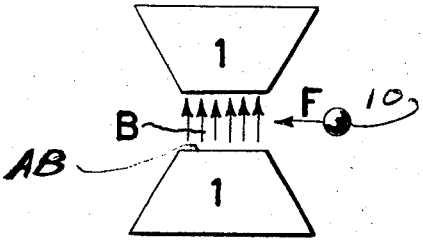
FIG. 4
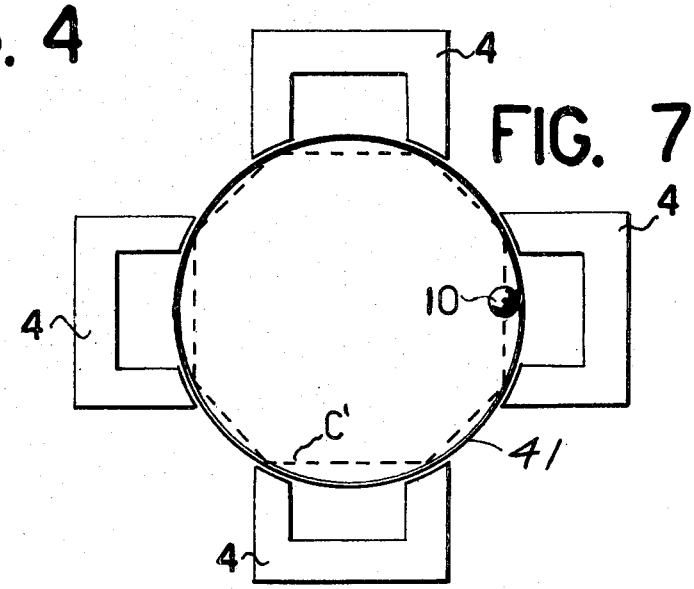
FIG. 7
FIG. 3
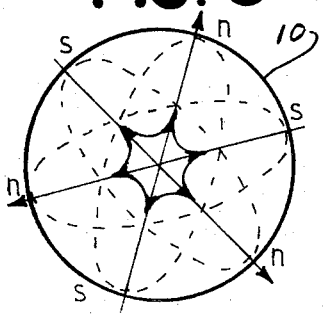
FIG. 2
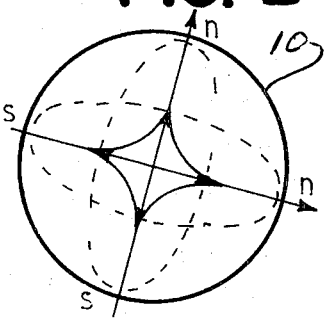
FIG. 1
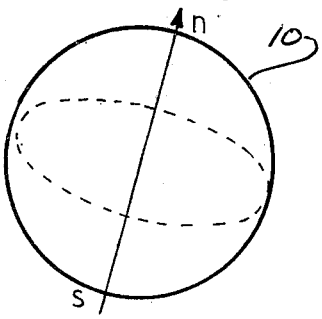

DEVICE FOR PROPELLING GRINDING BODIES IN A GRINDING MILL

BACKGROUND OF THE INVENTION

I. Field of the Invention

The present invention relates to a apparatus for propulsion of grinding bodies in a ball type mill.

II. Description of the Prior Art

In the known art, the kinetic energy or movement of the grinding bodies is created by elevating the bodies and then allowing them to fall from that height to substantially the bottom of the mill. However, since the balls or grinding bodies are in intimate contact or intermingled with the material to be ground, the raising of the grinding bodies also involves the raising of the material to be ground. Because the grinding process requires extended periods of time, production is more efficient when large quantities of the material can be ground in one operation. On the other hand, the treatment of large quantities involves large, heavy devices which must be kept in movement for long periods. Consequently, although a large quantity of energy is expended for their motion, the useful energy imparted to the grinding bodies is considerably less. Therefore, the prior known mills work inefficiently.

SUMMARY OF THE PRESENT INVENTION

An object of the present invention is to obviate the above-mentioned disadvantages.

With this object in view, the present invention provides an apparatus for the propulsion of grinding bodies in a grinding mill during grinding operations in which the material to be ground and/or the grinding bodies are at least partially made of ferro-magnetic material. The material contained in a grinding chamber of the grinding mill is then subjected to a variable or oscillating magnetic field, thereby causing motion of the particles and/or bodies within the chamber.

Thus, the apparatus employs magnetic attraction and repulsion of the grinding bodies in a manner which imparts high kinetic energy to the grinding bodies and induces a relatively rapid movement. The result is an intense grinding effect which has been previously unobtainable. Moreover, when the propulsion is accomplished by directly applying the motivating energy to the grinding bodies rather than the mill in which they are contained, the intensity of grinding can be regulated at will. In addition, the apparatus can be operated at constant levels of intensity much greater than the levels achievable with conventional equipment.

Furthermore, the paths of the grinding bodies are not limited to the previously known unilinear displacement of the bodies as in a conventional ball mill. Rather the bodies can be revolved or oscillated within a single plane, or they can be displaced in random or fixed three dimensional paths, whichever operation is required for the particular application.

The sole limitation of the operation of the device is the requirement that the grinding bodies be made from materials which are at least partially ferro-magnetic or ferri-magnetic. Such materials can be magnetized at two or more poles or non-magnetized when used in this invention.

The grinding bodies need not be spherical, because if the shape is non-spherical, the grinding tends to make any edges or corners round. One can also use mixtures of grinding bodies of different dimensions.

The apparatus disclosed obviates the conventional necessity for a mechanically operated mill since it requires only an electromagnetic device. Therefore, the structure of the mill can be simplified considerably and constructed for the sole function of containing grinding bodies and material to be ground. Thus, materials which are very hard but frangible in conventional mill applications may be utilized in mill construction.

BRIEF DESCRIPTION OF THE DRAWING

A better understanding of the ball grinding mill according to the present invention will be understood upon reference to the following detailed description when read in conjunction with the accompanying drawings, wherein like reference characters refer to like parts throughout the several views and in which:

FIG. 1 is a schematic view of a spherical grinding body magnetized at two poles;

FIG. 2 is a view substantially identical to FIG. 1 but showing a grinding body magnetized at four poles;

FIG. 3 is a view substantially identical to FIGS. 1 and 2 but showing a grinding body magnetized at six poles;

FIG. 4 is a diagrammatic view illustrating the method of the invention;

FIG. 5 is a diagrammatic view similar to FIG. 4, but showing a modification thereof;

FIG. 6 is a diagrammatic view illustrating the method of the present invention;

FIG. 7 is a diagrammatic view illustrating the reaction of a grinding body within the magnetic field inside the circular grinding chamber by utilizing a series of electro-magnets;

DETAILED DESCRIPTION OF THE PRESENT INVENTION

Figure 9:
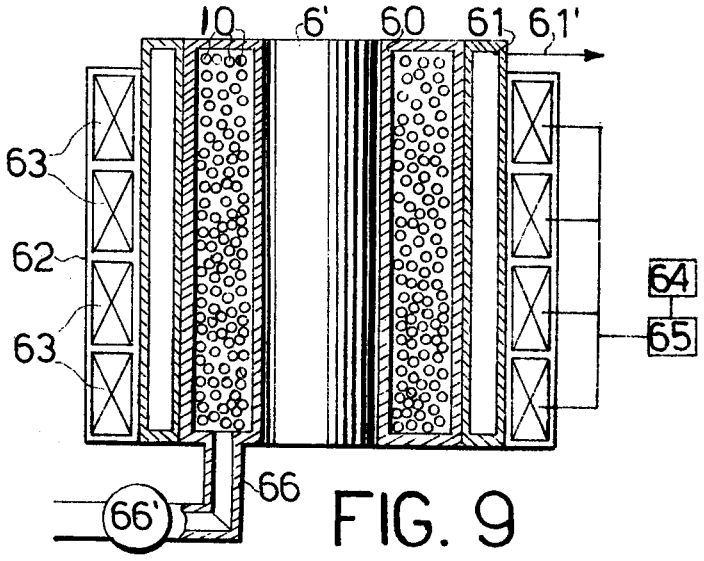
FIG. 9 is a sectional view of a grinding mill employing the method of the present invention.

With reference to the drawings, a number of grinding bodies 10 are provided. Each grinding body is in the conventional spherical form and made of soft (Low Hc) or hard (High Hc) ferro-magnetic material. In a preferred embodiment of the invention, the grinding bodies are polarized as indicated in either FIG. 1, 2, or 3. The number of poles may be increased or varied as required for the specific application. A grinding body 10 of this type which is placed in the vicinity of the two poles of an energized electromagnet 1 (FIG. 4) is attracted by a force F proportional to the square of the magnetic induction B and also to the area of the perpendicular section AB. If a second electromagnet 2 (FIG. 5) is placed adjacent to the first magnet 1, and the magnet 1 is de-energized while the magnet 2 is energized, the grinding body 10 which is made of ferro-magnetic material will continue along its horizontal path between the poles of the electromagnet 2. In practice, the path of each grinding body 10 will not be rectilinear but rather is altered by collisions with the internal walls and contents of the grinding chamber.

If several electromagnets 3 are arranged circumferentially around the grinding chamber as indicated by FIG. 6, the trajectory of each grinding body 10 will depend both on the direction and on the location of the electromagnets 3 and on the initial magnetic condition of the grinding body 10. FIG. 6 also illustrates a completed arrangement of electromagnetic poles 3, 3' and the resultant magnetic induction B, in addition to the grinding body 10. The broken line C indicates one exemplary course among the many which the grinding body 10 could follow.

The modification shown in FIG. 7 demonstrates the introduction of the magnetic field inside a grinding chamber 41 by using a series of electromagnets 4. In this case, the trajectory taken by the grinding bodies 10 could be the octagonal one C' illustrated in phantom line.

A grinding mill using ferro-magnetic or ferri-magnetic grinding bodies 10 functions substantially like an electric induction motor wherein the grinding chamber 40 constitutes the necessary air gap (see FIG. 6). However, the nucleus 3', which in conventional induction motors is represented by the rotor, remains stationary, thereby causing the electromagnetic force F to propel grinding bodies within the chamber between the nucleus 3' and the walls of the chamber 40. However, the nucleus 3' limits the capacity of the grinding chamber 40. Therefore, the nucleus 3' might preferably be replaced by an iron ring (not shown) in order to close the magnetic circuit.

Figure 8:
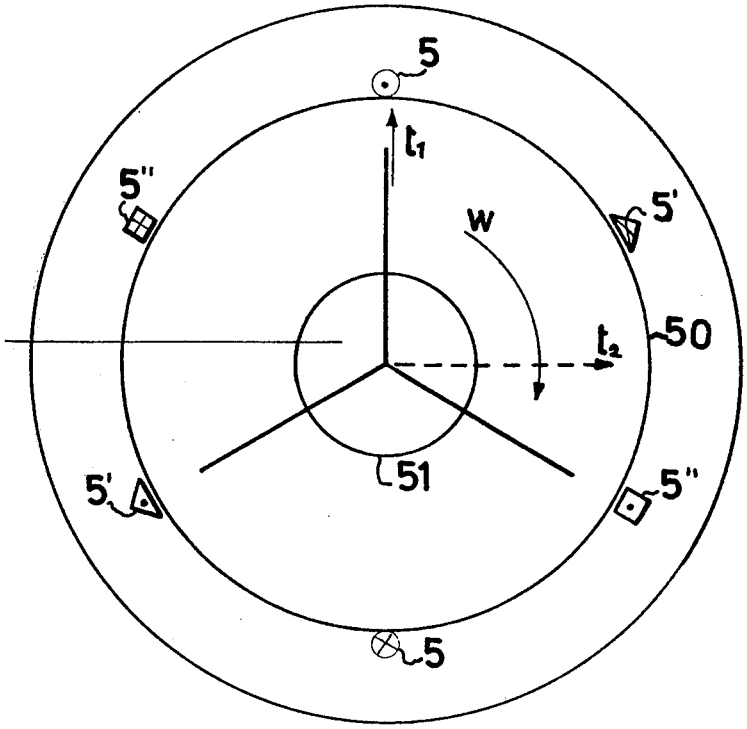
FIG. 8 shows schematically a three-phase winding around the grinding chamber.

In a preferred embodiment of the invention, shown schematically in FIG. 8, the grinding chamber 50 is surrounded by electrical windings 5, 5' and 5'' which are characteristic of those employed in three-phase asynchronous motors. The central nucleus 51 will behave like a blocked rotor having the secondary open. FIG. 8 also shows the interval of time t1-t2 in which the rotating magnetic field rotates at a velocity w.

FIG. 9 exemplifies another embodiment of the invention. A stationary nucleus consisting of a soft iron core 6' is mounted concentrically within an annular chamber 60. Another annular chamber 61 surrounds the chamber 60 and provides a cooling jacket which removes the heat produced during the grinding operation. This second chamber 61 is surrounded by an external cylinder 62 of magnetic steel containing coils 63 for generating the magnetic field. These coils 63 are fed with a current from a supply 64 through a frequency and current controller 65. Only the grinding bodies 10 are shown within the chamber 60. The bottom of the grinding chamber 60 is connected through a tube 66 to a pump 66' which transfers material into and out of the chamber 60.

The operation of the devices of the present invention requires a variable magnetic field and grinding bodies comprising ferri-magnetic or ferro-magnetic material. The magnetic field can be varied by directly regulating the frequency of the current which induces the magnetic field. The variation of the frequency of the supply current can be achieved in any suitable manner, for example by the use of electromechanical or electronic devices.

The invention disclosed is also intended to include the special application in which particles of the material to be ground are propelled by the magneto-motive force with sufficient energy such that they will be ground without requiring the insertion of separate grinding bodies.

Since the invention has been described and shown merely by way of example and not restrictively, it is self-evident that numerous modifications can be made to its whole and to its details, without departing from the spirit of the invention as defined by the appended claims.

We claim:

1. A grinding apparatus comprising:

a housing defining a grinding chamber adapted to receive a material to be ground, a nucleus stationarily secured substantially centrally in said grinding chamber, said nucleus being constructed of a magnetic material, at least one grinding body constructed of a magnetic material and adapted to be placed in said chamber between said nucleus and said housing, and means for generating an oscillating magnetic field in said chamber, said means comprising a plurality of stationary electric coils positioned at spaced locations around and exteriorly of said grinding chamber which, when connected to an alternating three phase source of electrical power, produces an oscillating magnetic field between said coils and said nucleus to thereby drive the grinding body between the housing and the nucleus.

2. The invention as defined in claim 1 wherein the nucleus is made of soft iron.

3. The invention as defined in claim 1 wherein each grinding body includes at least two magnetic poles.

* * * * *